US005203757A

United States Patent [19]

Kampen

[11] Patent Number: 5,203,757

[45] Date of Patent: Apr. 20, 1993

[54] METHOD AND APPARATUS FOR PRODUCING TOBACCO SMOKE FILTER RODS

[75] Inventor: Walter Kampen, Freiburg, Fed. Rep. of Germany

[73] Assignee: Rhone Poulenc Rhodia AG, Freiburg, Fed. Rep. of Germany

[21] Appl. No.: 826,391

[22] Filed: Jan. 27, 1992

Related U.S. Application Data

[60] Division of Ser. No. 614,985, Nov. 15, 1990, Pat. No. 5,106,357, which is a continuation of Ser. No. 120,819, Nov. 16, 1987, abandoned.

[30] Foreign Application Priority Data

Nov. 29, 1986 [DE] Fed. Rep. of Germany ..... 3640883

[51] Int. Cl.[5] ..... B65H 51/00; B65H 55/00; B65H 57/00

[52] U.S. Cl. ..... 493/44; 493/45; 493/48; 493/49; 131/336

[58] Field of Search ..... 493/44, 45, 48, 49; 131/336; 156/180, 441

[56] References Cited

U.S. PATENT DOCUMENTS

| | | | |
|---|---|---|---|
| 3,111,702 | 11/1963 | Berger . | |
| 3,173,188 | 3/1965 | Wexler et al. . | |
| 3,323,961 | 6/1967 | Hagher | 156/180 |
| 3,853,039 | 12/1974 | Haslam et al. | 156/180 |
| 4,522,616 | 6/1985 | Hyde et al. | 493/44 |
| 4,661,090 | 4/1987 | Arthur | 493/44 |

FOREIGN PATENT DOCUMENTS

| | | |
|---|---|---|
| 0088178 | 9/1983 | European Pat. Off. . |
| 2218071 | 11/1972 | Fed. Rep. of Germany . |
| 2708873 | 9/1977 | Fed. Rep. of Germany . |
| 3150831 | 8/1982 | Fed. Rep. of Germany . |
| 2356382 | 6/1977 | France . |
| 2091984 | 12/1981 | United Kingdom . |
| 2166642 | 11/1985 | United Kingdom . |

*Primary Examiner*—Bruce M. Kisliuk
*Assistant Examiner*—Jack Lavinder
*Attorney, Agent, or Firm*—Stevens, Davis, Miller & Mosher

[57] ABSTRACT

Filter tow comprising crimped spun fibers and/or filaments is prepared in a preparation zone and fed to a processing zone where it is gathered, in an intake zone, then wrapped and cut into tobacco smoke filter rods. In the region of the intake zone, a gas or vapor under elevated pressure acts on the filter tow at an angle of less than 90° to the longitudinal axis of the filter tow in the direction of movement of the filter tow. The relevant apparatus includes a preparation unit and a processing unit, the latter unit for feeding a gas or vapor under elevated pressure to the filter tow in the direction of movement thereof including:

an intake finger (14) having holes (17) in the wall thereof on the filter tow intake side, or a pipe (22), whose gas or vapor exit end 23 terminates in the region of the filter tow outlet side of the intake funnel (23) or the filter tow intake side of the intake finger (14), or a blowing device (27) immediately upstream of the filter tow intake side of the intake finger (14).

5 Claims, 9 Drawing Sheets

METHOD AND APPARATUS FOR PRODUCING TOBACCO SMOKE FILTER RODS

This is a division of application Ser. No. 07/614,985, filed Nov. 15, 1990, now U.S. Pat. No. 5,106,357 which in turn is a continuation of application Ser. No. 07/120,819, filed Nov. 16, 1987, now abandoned.

FIELD OF THE INVENTION

The invention relates to a method and apparatus for producing tobacco smoke filter rods, particularly cigarette filter rods.

The method relates to a filter tow, drawn off from a stock comprising crimped spun fibers and/or filaments. The tow is spread out, loosened, stretched, relaxed and optionally provided with plasticizer in a preparation zone. Then it is passed to a processing zone, where it is gathered together in an intake zone, then wrapped with a wrapping strip, if appropriate, and finally, the continuous tobacco smoke filter rod is cut into individual tobacco smoke filter rods.

The invention further relates to apparatus for carrying out the method, having in each case a preparation unit, which possesses means for spreading out, loosening, stretching and relaxing the filter tow and if appropriate a means for providing the filter tow with plasticizer. The apparatus also includes a processing unit, which if appropriate possesses an intake nozzle for conveying the filter tow, and also possesses an intake means for gathering the filter tow, having an intake funnel, if appropriate, and having an intake finger. The processing unit also optionally includes a wrapping means for wrapping the filter tow with a wrapping strip and also a cutting means for cutting the continuous tobacco smoke filter rod formed into individual tobacco smoke filter rods.

BACKGROUND OF THE INVENTION

The expression "filter tow" means a non-woven filter material comprising a large number of crimped, for example synthetic, spun fibers and/or filaments. The filter tow can, for example comprise crimped cellulose acetate, in particular cellulose 2,5-acetate, spun fibers and/or filaments.

Conventional apparatus for producing tobacco smoke filter rods normally comprise a preparation unit and a processing unit.

The preparation unit conventionally possesses apparatus for spreading, loosening, stretching and relaxing the filter tow. Also, if the filter tow is to be provided with plasticizer, the unit includes a means for wetting the spun fibers and/or filaments of the filter tow with a plasticizer.

The processing unit conventionally includes an intake means for gathering the filter tow, having an intake funnel and an intake finger. In addition, if the filter tow is to be wrapped in, for example, paper, the unit includes a wrapping means for wrapping the filter tow with a wrapping strip and a cutting means for cutting the continuous tobacco smoke filter rod, formed by the gathering and optional wrapping into individual tobacco smoke filter rods.

In conventional modern apparatus for producing tobacco smoke filter rods, an intake nozzle for conveying the filter tow is installed upstream of the intake funnel, viewed in the direction of movement of the filter tow. The wall of the intake funnel has holes for the escape from the intake funnel of the gas supplied through the intake nozzle. The gas is preferably air. Other known gases can be used.

In conventional methods and apparatus for producing tobacco smoke filter rods, an endless filter tow consists, for example, of crimped cellulose-2,5-acetate spun fibers and/or filaments. The filter tow is superposed in layers and thus compressed into a bale. It is drawn off continuously from the surface of this bale, spread out, passed over a roll or similar guide member, and then spread out again. It is guided through braking rollers, stretched, relaxed, spread out again, sprayed with plasticizer, guided over deflection rollers and through an intake nozzle and thence through an intake funnel and an intake finger. If appropriate, the filter tow is wrapped with a wrapping strip of, for example, paper, whereafter the continuous tobacco smoke filter rod thus formed is cut into finished tobacco smoke filter rods. The effect of stretching the filter tow is that the crimped spun fibers and/or filaments separate from each other. When the filter tow is subsequently relaxed, it contracts with fluffing, because of its crimping elasticity. The capability for fluffing depends on whether the stretching is performed in an ideal manner. The stretching should not be too weak, so that complete separation of the fibers takes place, but also not too strong, so that no plastic deformation occurs.

However, the conventional methods and apparatus for producing tobacco smoke filter rods, particularly cigarette filter rods, possess the following disadvantages.

With increasing speed and if appropriate also increasing fluffing of the filter tow, there is an increase in friction between the filter tow and the surrounding air in the region between deflection rollers and intake nozzle. This causes an increase in the tendency to wind at the deflection rollers. This means that the filter tow can easily wind around the deflection rollers.

To draw off the fluffy filter tow safely from the deflection rollers, the pressure of the gas with which the intake nozzle is operated must be increased.

Fluffy filter tow is pressed by the gas flow, which is preferably an airflow, out of an intake nozzle into an intake funnel and intake finger which follows. The higher the air pressure in the intake nozzle, the more filter tow material can be pressed into the intake finger. A prerequisite for this is, of course, that correspondingly more filter tow material is delivered from the preparation unit and hence from the stretching apparatus. When this occurs, the quantity of filter tow to be introduced into the intake finger is limited. This occurs due to the frictional forces of the filter tow material against the inner wall of the intake funnel and against the inner wall of the intake finger due to the friction of the spun fibers and or filaments against each other and due to the stiffness of the spun fibers and/or filaments.

However, with increasing intake nozzle pressure and hence increased quantity of filter tow in the intake funnel, the uniform distribution of the mass of filter tow in the finished tobacco smoke filter rods deteriorates because the mass becomes heterogeneous. The result of this is that the drawing resistance likewise becomes non-uniform over the length of these filter rods and from rod to rod.

As the speed of operation, that is the speed at which the filter tow runs through the processing unit, increases, the material characteristic shortens. Material characteristic is the term given to the relationship between the drawing resistance and the filter tow weight which is obtained for a particular size of tobacco smoke filter rod with a filter tow on an apparatus producing tobacco smoke filter rods. This can be compensated by increasing the intake nozzle pressure which means that increasing the gas pressure of the intake nozzle does result in lengthening of the material characteristic. However, as described above, increasing the intake nozzle pressure in such a manner again results in a drawing resistance which is non-uniform over the length of the finished tobacco smoke filter rods and also from rod to rod.

SUMMARY OF THE INVENTION

An object of the invention is to provide a method for producing tobacco smoke filter rods, particularly cigarette filter rods. An object includes avoiding formation of coils at the deflection rollers with increasing speed, and if appropriate also increasing fluffing, of the filter tow. It is unnecessary to increase the intake nozzle pressure or even possible to reduce it. It is also possible even to dispense with the intake nozzle.

It is a further object that more filter tow material can be introduced into the intake finger and hence into the finished tobacco smoke filter rods. These filter rods possess a uniform drawing resistance. It is unnecessary to increase the intake nozzle pressure or even possible to reduce it. It is also possible even to dispense with the intake nozzle.

It is also an object that at relatively high speeds of operation, the material characteristic can be lengthened. At the same time, a uniform drawing resistance in the finished tobacco smoke filter rods can be obtained. It is unnecessary to increase the intake nozzle pressure or even possible to reduce it. It is also possible even to dispense with the intake nozzle.

These objectives are achieved, on the basis of the method described in this disclosure, by means of the features recited in the claims.

A further object of the invention is to provide an apparatus for carrying out the method according to the invention. This object is achieved using the apparatus described in this disclosure and recited in the claims.

The invention possesses several advantages. First, the formation of coils at the deflection rollers of the apparatus for producing tobacco smoke filter rods is avoided.

Next, for a predetermined filter tow weight per tobacco smoke filter rod and a predetermined drawing resistance, it is possible to reduce the intake nozzle pressure compared with conventional processes and apparatus. This improves the homogeneous character of the mass of the filter tow in the finished filter rods. Thus, in turn, a uniform drawing resistance is achieved over the length of the filter rods and from rod to rod.

Third, as a result of the action on the filter tow, in the direction of movement thereof, of a gas or of vapor under elevated pressure in the region of the intake zone the spun fibers and/or filaments of the filter tow are evidently subjected to a high degree of swirling. This occurs in accordance with the invention because the drawing resistance increases compared to a tobacco smoke filter rod with the same filter tow weight produced in accordance with the state of the art. This means therefore, that for a predetermined drawing resistance, less filter tow material per tobacco smoke filter rod is required in accordance with the invention. Even at relatively high operating speeds the material characteristic can be lengthened and thus a uniform drawing resistance can be achieved over the length of the finished tobacco smoke filter rods and from rod to rod. Even at relatively high operating speeds, it is unnecessary to increase the intake nozzle pressure or even possible to reduce it. It is even possible to dispense with the intake nozzle.

With the apparatus, it is no longer necessary, when this apparatus is started up, to draw the filter tow under the intake finger to the format tape by hand. This is so because the gas fed to the filter tow through the holes in the wall of the intake finger or the corresponding vapor automatically transports the filter tow to the format tape.

BRIEF DESCRIPTION OF THE DRAWINGS

The invention is explained in detail below with reference to the drawings which are not considered to limit the invention, in which.

DETAILED DESCRIPTION

Figure 1:
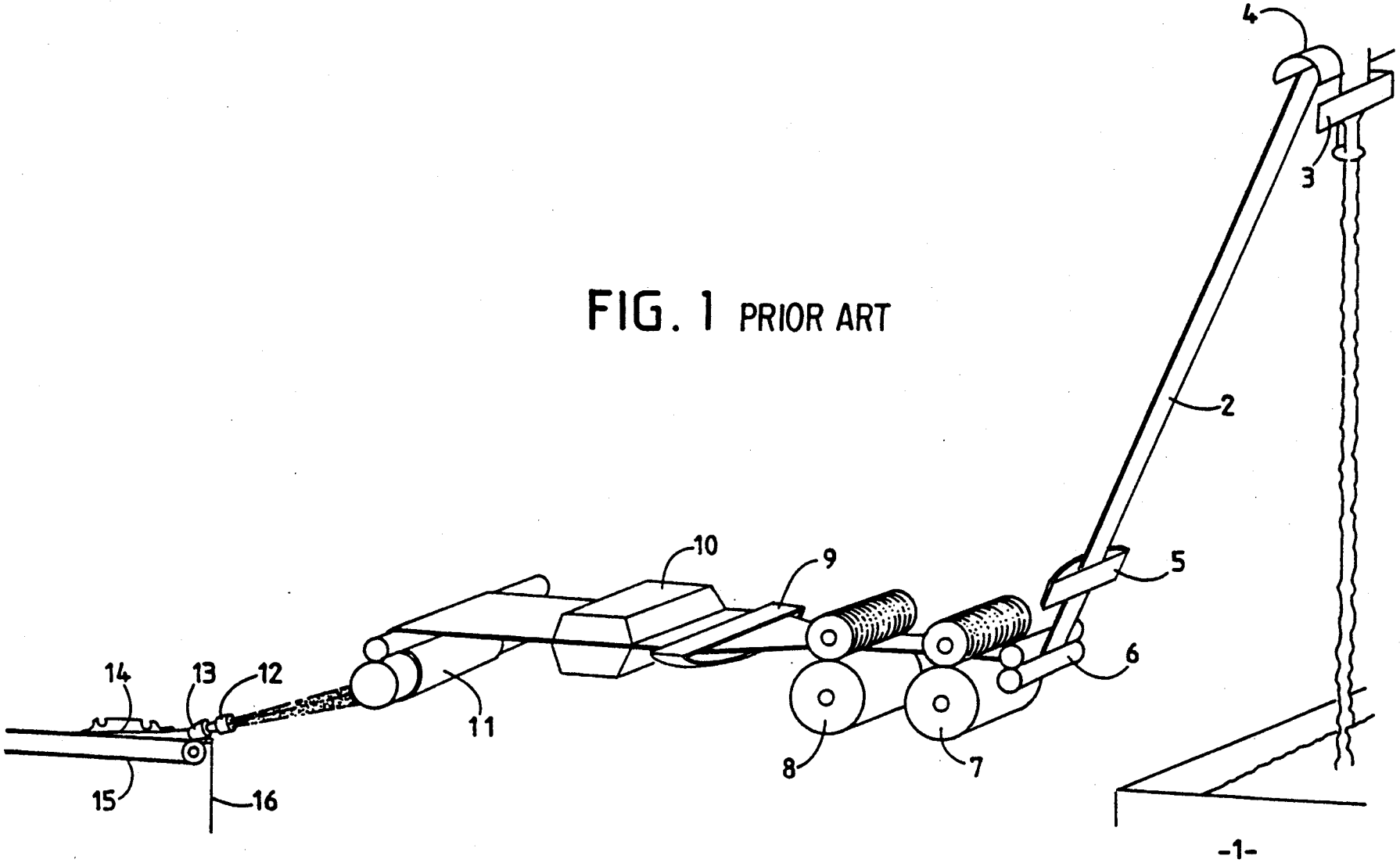
FIG. 1 PRIOR ART
FIG. 1 shows diagrammatically a conventional apparatus for producing cigarette filter rods, having a filter tow preparation unit and a filter tow processing unit installed downstream thereof.

FIG. 1 shows a conventional apparatus for producing cigarette filter rods. It has a preparation unit which possesses a first spreading nozzle 3, a guide member 4, a second spreading nozzle 5, braking rollers 6, a first pair of stretching rollers 7, a second pair of stretching rollers 8, a third spreading nozzle 9, a spraying device 10, for spraying the spun fibers and/or filaments of the filter tow with a plasticizer, and deflection rollers 11. It also has a processing unit, which possesses an intake nozzle 12, an intake funnel 13, an intake finger 14 and a format tape 15.

Figure 2:
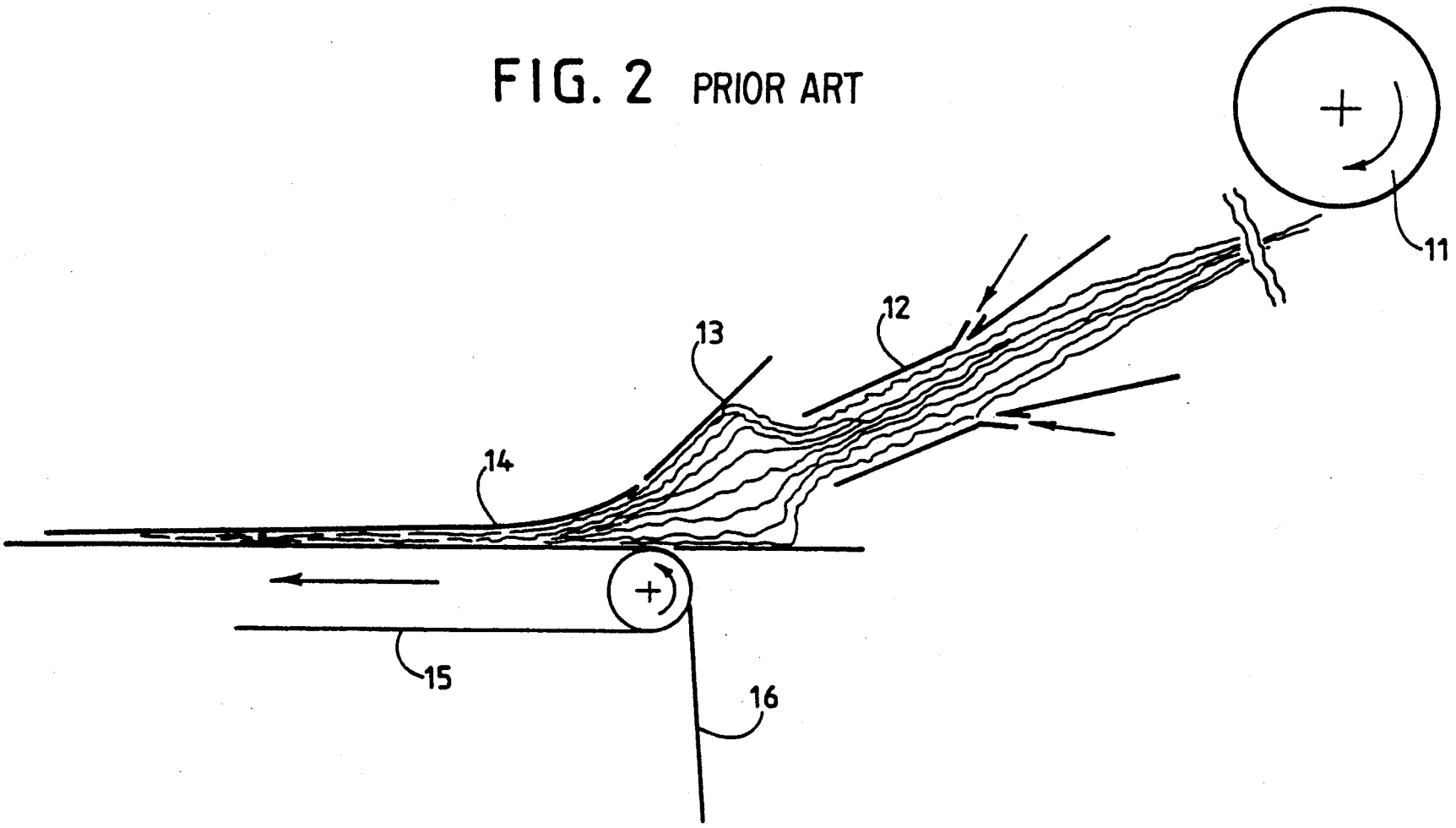
FIG. 2 PRIOR ART
FIG. 2 shows diagrammatically and in section the part of the apparatus according to FIG. 1 which comprises a deflection roller, an intake nozzle, an intake funnel, an intake finger and a format tape.

FIG. 2 shows part of the conventional apparatus according to FIG. 1. It has a deflection roller 11, an intake nozzle 12, an intake funnel 13, an intake finger 14 and a format tape 15.

The mode of operation of the apparatus according to FIGS. 1 and 2 follows. The filter tow 2 is continuously drawn off from the bale 1. The tow is passed through the first—air-operated—spreading nozzle 3 where it is spread out and passed over the guide member 4. Then it is passed through the second—likewise air-operated—spreading nozzle 5 where the filter tow 2 is again spread out, and passed to the stretching means. That means comprises the pair of braking rollers 6, the first pair of stretching rollers 7, and the second pair of stretching rollers 8, where it is stretched. Downstream of the stretching means the filter tow 2 relaxes. It is guided through the third—also air-operated—spreading nozzle 9. There it is again spread out, guided through the spraying device, where it is sprayed with plasticizer, guided over deflection rollers 11, and through the—air-operated—intake nozzle 12. Then it is guided to the intake funnel 13 and the intake finger 14, where the filter tow 2 is gathered to form a continuous rod. The filter tow 2, gathered to form a continuous rod, is finally wrapped by means of the wrapping means 15 (the format tape 15) with a wrapping strip 16 (paper strip 16), which is provided with adhesive. Thereafter, it is cut into individual cigarette filter rods by the cutting apparatus (not shown).

The apparatus described above for producing cigarette filter rods shows the disadvantages listed above.

FIGS. 3, 4, 7, 8, 9, 11 and 13 each show the parts of an apparatus according to the invention, in which parts the disadvantages described no longer occur.

Figure 3:
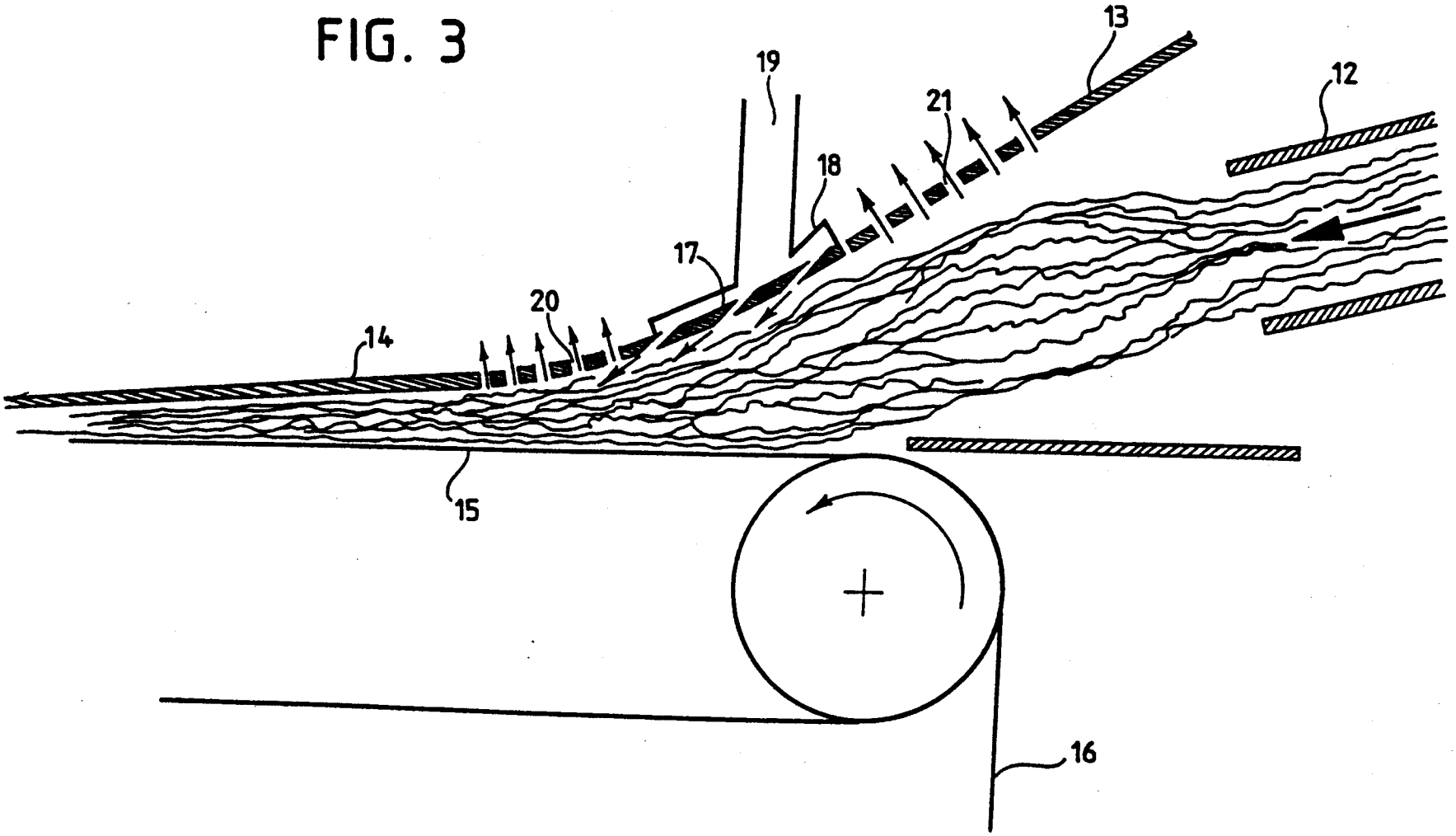
FIG. 3 shows diagrammatically and in section part of an apparatus according to the invention and as claimed, having an intake finger, a part of an intake nozzle, and also an intake funnel and format tape.

FIG. 3 shows part of the—usually air-operated—intake nozzle 12. The figure also shows the intake funnel 13 having holes or apertures 21 for the escape from the intake funnel 13 of the air supplied by the intake nozzle 12. It further shows an intake finger 14 having holes or apertures 17 for feeding a gas or vapor under elevated pressure to the filter tow in the direction of movement thereof. It further shows holes or apertures 20 for the escape from the intake finger 14 of the gas or vapor supplied through the holes 17. Finally, it shows a wrapping means 15 (a format tape 15) for wrapping the filter tow gathered to form a continuous rod with a wrapping strip 16 (paper strip 16). FIG. 3 additionally shows a jacket 18, by which the region of the holes 17—which are arranged in the wall of the intake finger 14—can be surrounded. Compressed air, for example, can be fed through the inlet 19 of the jacket 18 and thus through the holes 17 to the filter tow.

Figure 4A:
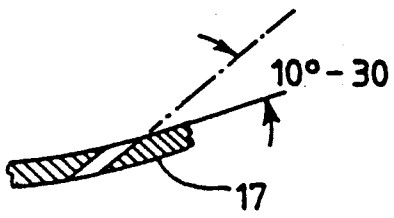
FIGS. 4–4*b* shows diagrammatically and in section part of an apparatus according to the invention as claimed, with an intake finger and—likewise diagrammatically and in section—enlarged representations of the holes 17 and 20 in the wall of the intake finger.
Figure 4B:
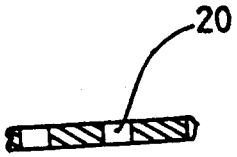
Figure 4:
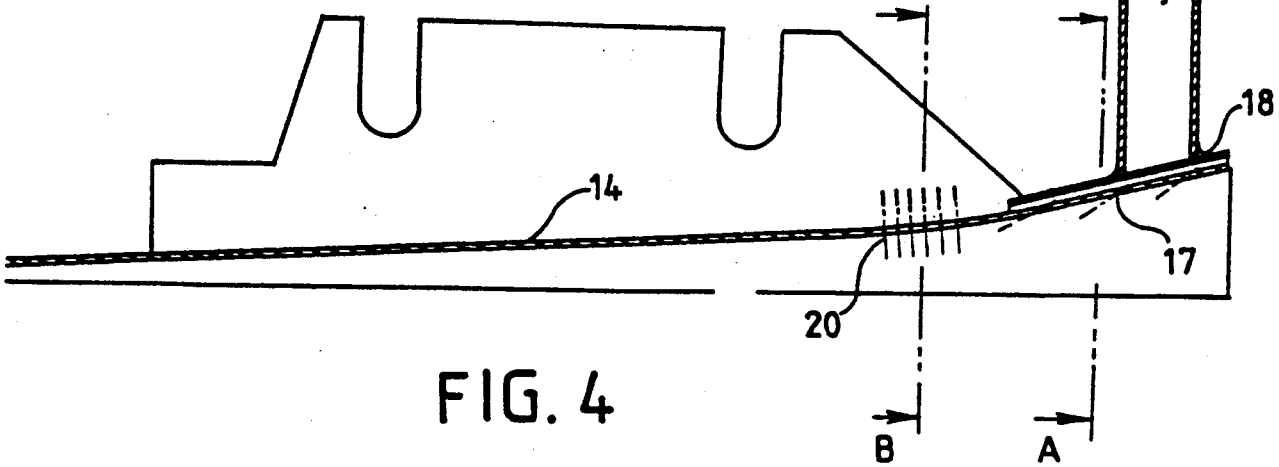

FIG. 4 shows an intake finger 14 having holes 17 for feeding a gas or vapor under elevated pressure to the filter tow in the direction of movement thereof. It further shows holes 20 for the escape from the intake finger of the gas or vapor supplied through the holes 17. FIG. 4—like FIG. 3—also shows a jacket 18, by which the region of the holes 17 can be surrounded, having an inlet 17. It also shows enlarged representations of the holes or channels 17 and 20 in the wall of the intake finger 14. The enlarged representation of the holes 17, clearly shows that the axis of the bores of the holes 17 can form an angle from 10° to 30° (that is less than 90°) to the longitudinal axis of the intake finger 14 in the direction of movement of the filter tow. Angles greater than 30° can be selected.

Figure 5:
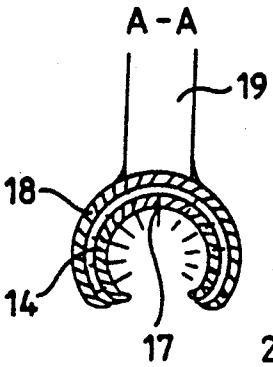
FIG. 5 shows a section along line A—A in FIG. 4.

FIG. 5 shows a jacket 18 with the inlet 19 and the intake finger 14 with the holes 17.

Figure 6:
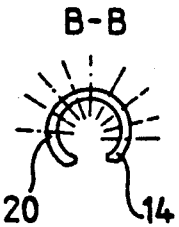
FIG. 6 shows a section along line B—B in FIG. 4.

FIG. 6 shows the intake finger 14 with the holes 20.

Figure 7:
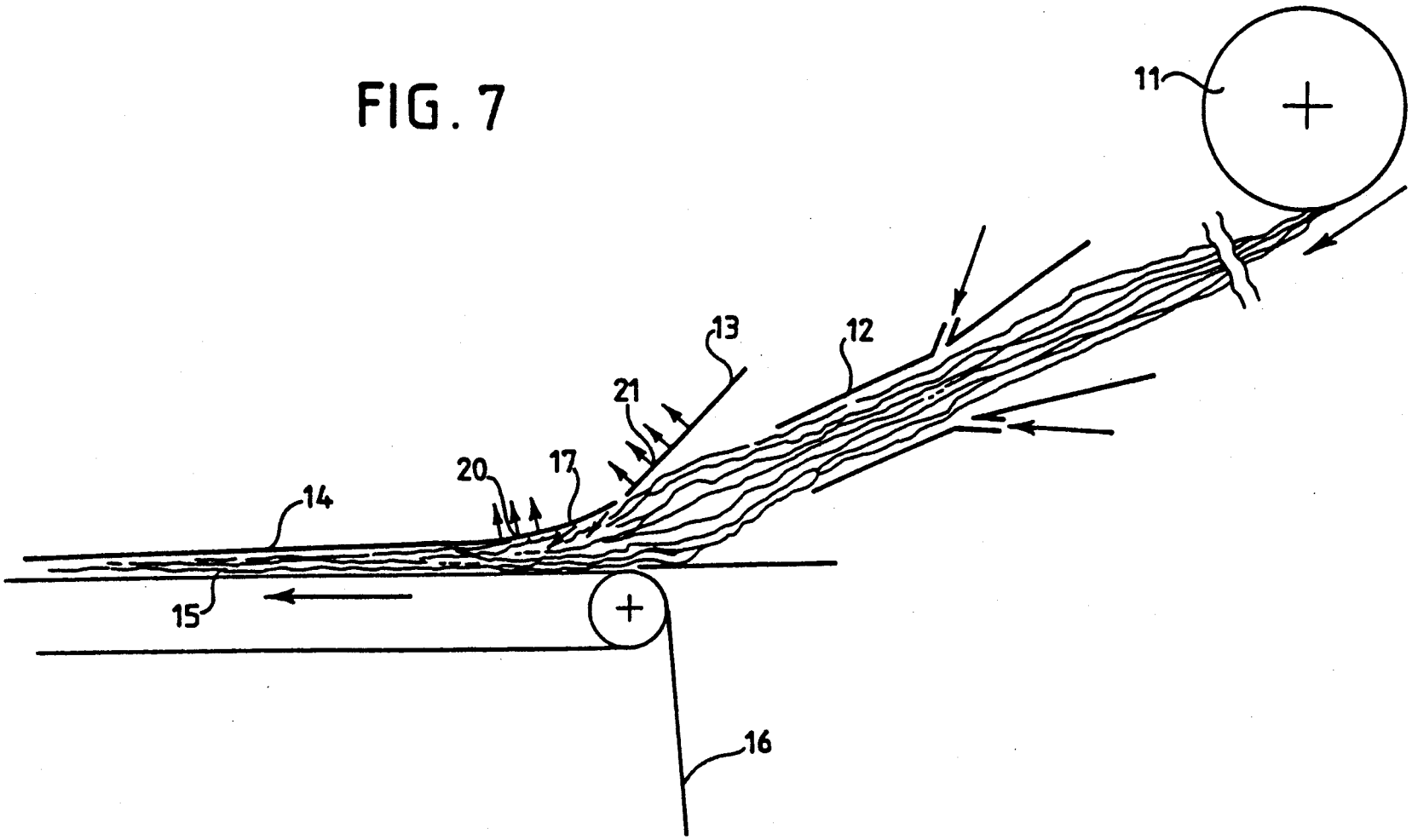
FIG. 7 shows diagrammatically and in section part of an apparatus according to the invention as claimed, with an intake finger and a deflection roller, and also an intake nozzle, an intake funnel and a format tape.

FIG. 7 shows a deflection roller 11, and—conventionally air-operated—intake nozzle 12, and the intake funnel 13 with holes 21 for the escape from the intake funnel 13 of the air supplied through the intake nozzle 12. It also shows an intake finger 14 with holes 17 for feeding a gas or vapor under elevated pressure to the filter tow in the direction of movement thereof and with further holes 20 for the escape from the intake finger 14 of the gas or vapor supplied through the holes 17. Finally, it shows a wrapping apparatus 15 (a format tape 15) with the aid of which the filter tow, gathered to form a continuous rod, is wrapped with a wrapping strip 16 (paper strip 16).

Figure 8:
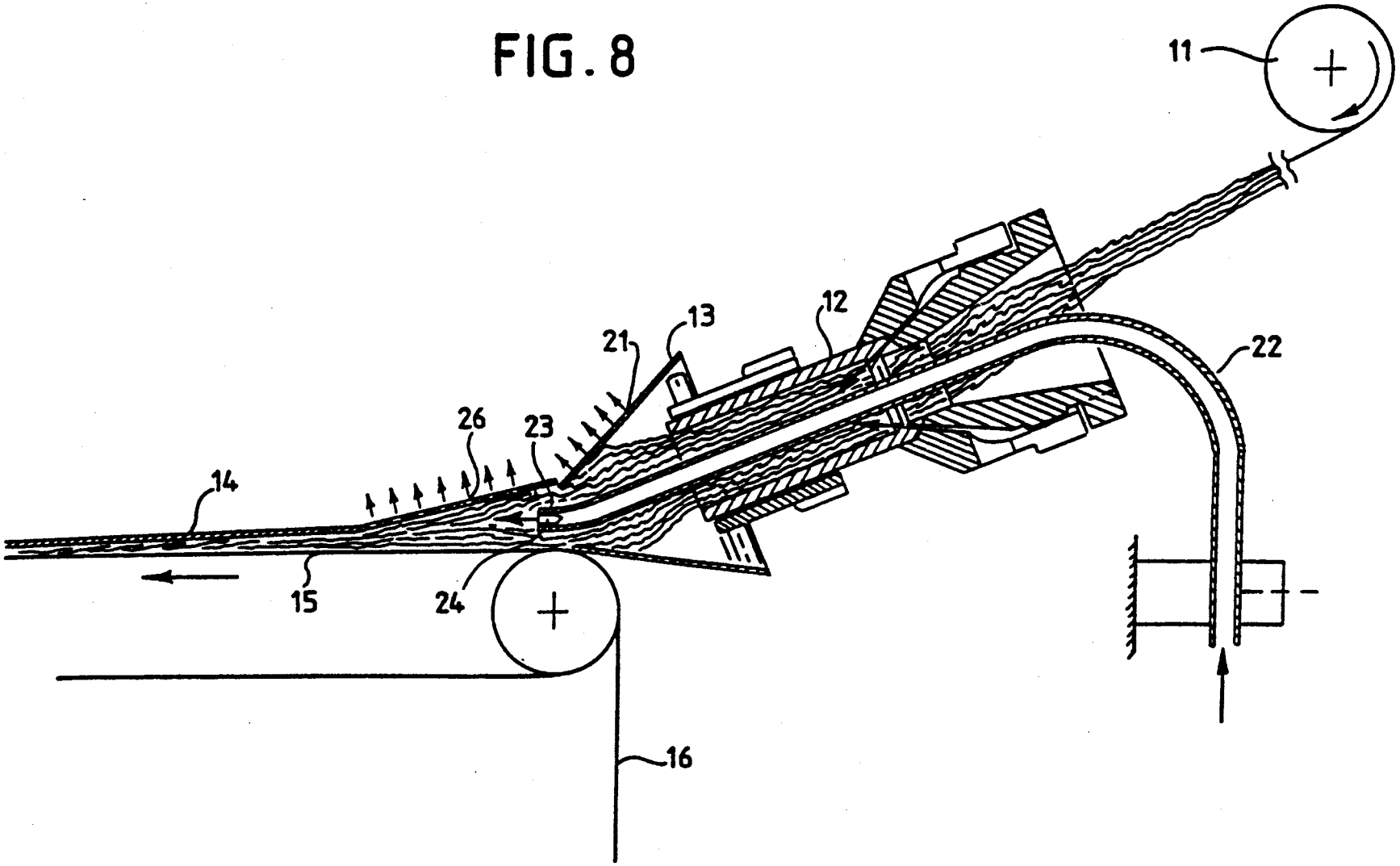
FIG. 8 shows diagrammatically and in section part of an apparatus according to the invention as claimed with a pipe for feeding a gas or vapor under elevated pressure to the filter tow in the direction of movement thereof, a deflection roller, an intake nozzle, an intake funnel, an intake finger and a format tape.
Figure 9:
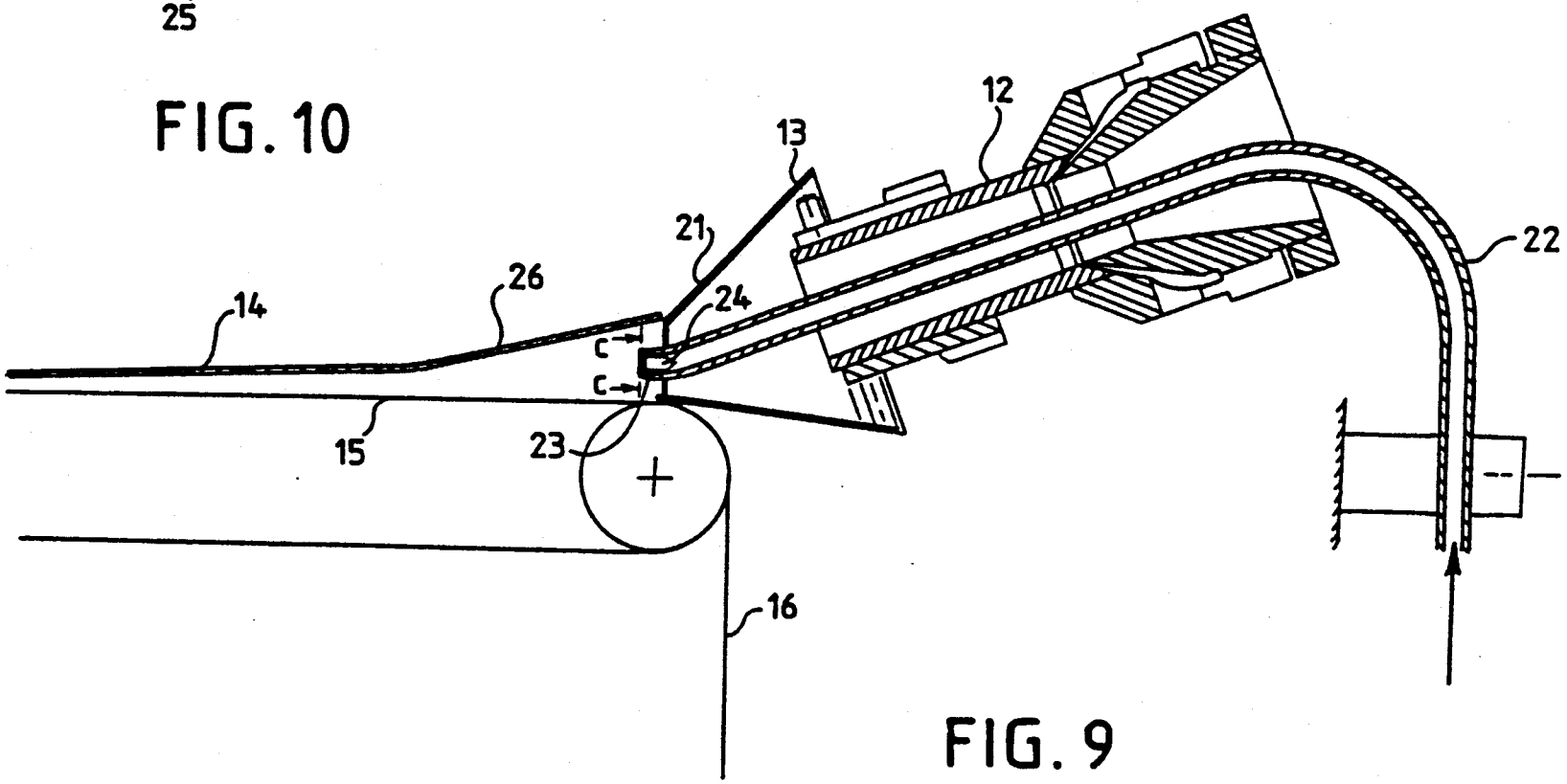
FIG. 9 shows diagrammatically and in section part of an apparatus according to the invention as claimed with a pipe for feeding a gas or vapor under elevated pressure to the filter tow in the direction of movement thereof, a deflection roller, an intake nozzle, an intake funnel, an intake finger and a format tape.

FIGS. 8 and 9 show the—conventionally air-operated —intake nozzle 12, the intake funnel 13 with holes 21 for the escape from the intake funnel 13 of the air supplied through the intake nozzle 12. It also shows a pipe 22 for feeding a gas or vapor under elevated pressure to the filter tow in the direction of movement thereof. An intake finger 14 is shown, on whose filter tow intake side holes 26 for the escape from the inlet finger 14 of the gas or vapor supplied through the pipe 22 are arranged in the wall thereof. A wrapping means 15 (a format tape 15) is shown, with the aid of which the filter tow gathered to form a continuous rod is wrapped with a wrapping strip 16 (paper strip 16).

FIGS. 8 and 9 clearly show that the pipe 22 passes through the intake nozzle 12, passes into the intake funnel 13, and that the gas or vapor exit end 23 of the pipe 22 terminates in the region of the filter tow intake side of the intake finger 14.

FIGS. 8 and 9 further show that the gas or vapor exit end 23 of the pipe 22 is designed as a slit nozzle by means of a —solid—insert 24. The insert possesses a lesser diameter than the internal diameter of the pipe 22.

Figure 10:
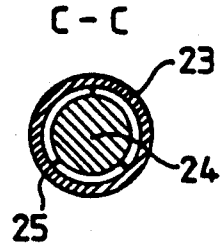
FIG. 10 shows a section along line C—C in FIG. 9.

The gas or vapor exit end 23 of the pipe 22 is shown in FIG. 10.

FIG. 10 shows that the gas or vapor exit end 23 of the pipe 22 is designed as an (annular) slit nozzle by means of a —solid—insert 24. It possesses a lesser diameter than the internal diameter of the pipe 22 and which is connected by webs 25 to the inner wall of the pipe 22.

Figures 11, 12:
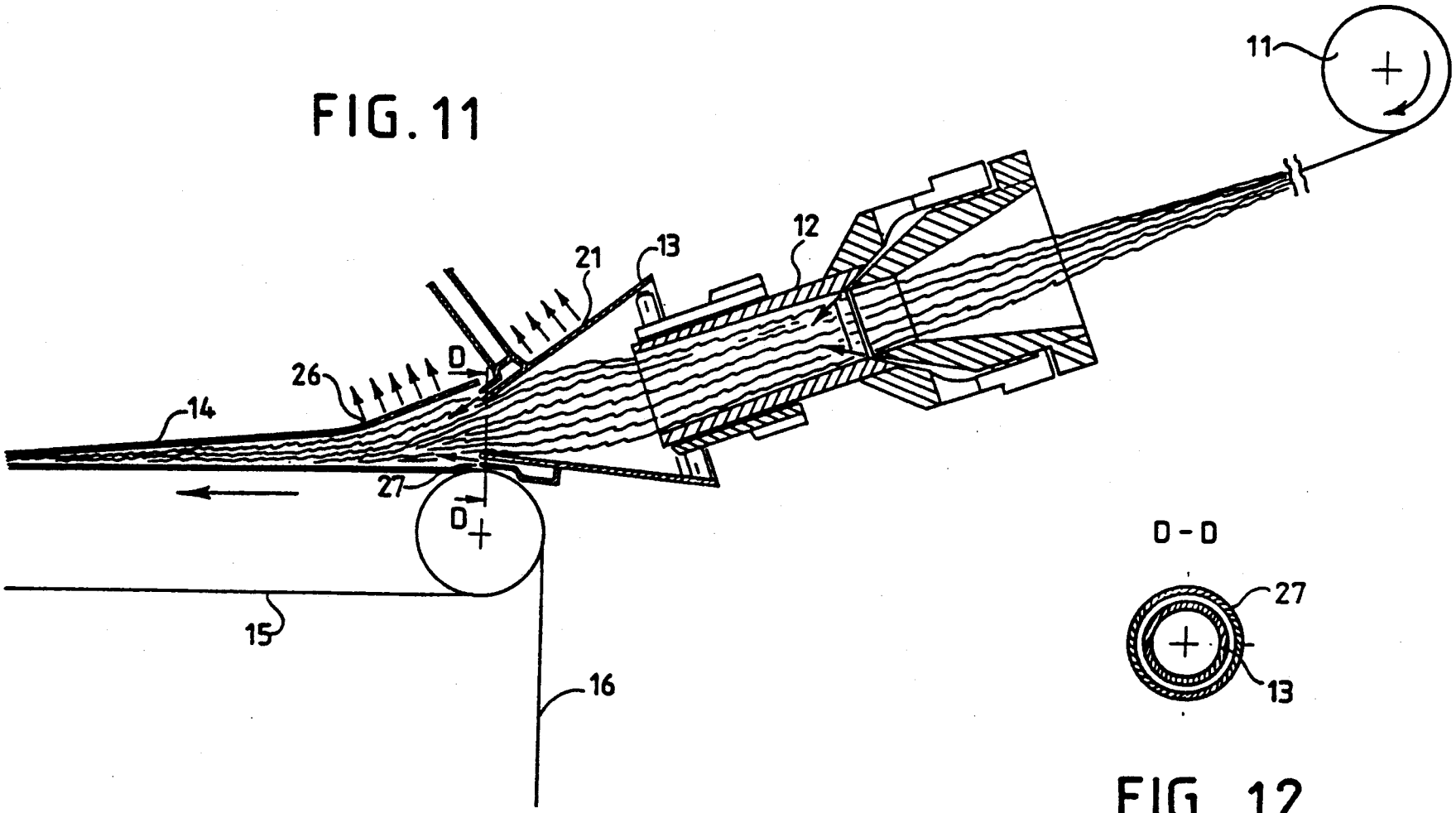
FIG. 11 shows diagrammatically and in section part of an apparatus according to the invention as claimed with a deflection roller, an intake nozzle, an intake funnel, an intake finger and a format tape.
FIG. 12 shows a section along line D—D in FIG. 11.

FIG. 11 shows a deflection roller 11, the—conventionally air-operated—intake nozzle 12 and the intake funnel 13 with holes 21 for the escape from the intake funnel 13 of the air supplied through the intake nozzle 12. It also shows a blowing device 27, for feeding a gas or vapor under elevated pressure to the filter tow in the direction of movement thereof. An intake finger 14, is shown on whose filter tow intake side holes 26 for the escape from the intake finger 14 of the gas or vapor supplied by the blowing device 27 are arranged in the wall thereof. A wrapping means 15 (a format tape 15), is shown, with the aid of which the filter tow gathered to form a continuous rod is wrapped with a wrapping strip 16 (paper strip 16). FIG. 11 shows that the gas supplied by the blowing device 27 or the vapor supplied by the blowing device 27 is introduced—in the direction of movement of the filter tow—into the intake finger 14. This occurs at an angle of less than 90° to the longitudinal axis of the intake finger 14. FIG. 11 also shows that the blowing means 27 has the form of a slit nozzle. This slit nozzle is arranged on the outer wall of the intake nozzle 13.

FIG. 12 shows that the blowing means 27 has the form of an annular slit nozzle.

Figures 13, 14:
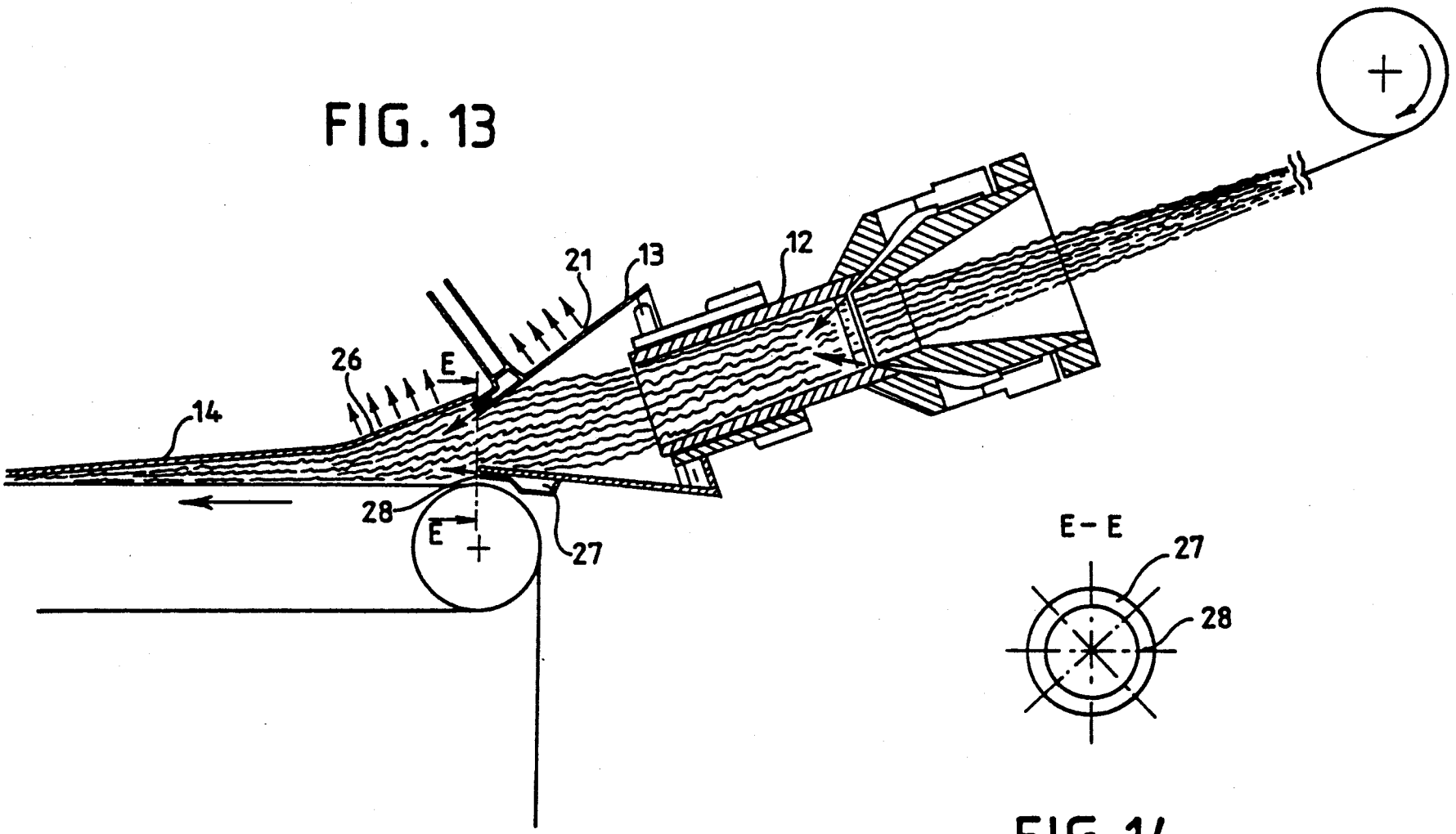
FIG. 13 shows diagrammatically and in section part of an apparatus according to the invention as claimed with an intake nozzle, an intake funnel and an intake finger.
FIG. 14 shows a section along line E—E in FIG. 13.

The intake nozzle 12, the intake funnel 13 with holes 21 in the wall thereof, a blowing device 27 with holes 28 and an intake finger 14, with holes 26 on the filter tow intake side in the wall of the intake finger 14, for the escape from the intake finger 14 of the gas or vapor supplied by the blowing device 27 are shown in FIG. 13.

FIG. 13 also shows that the blowing device 27 possesses holes 28 for supplying the gas or the vapor, and that the axis of the bores of these holes 28 form an angle of less than 90° to the longitudinal axis of the intake finger 14 in the direction of movement of the filter tow.

FIG. 14 shows that the blowing device 27 possesses a ring of holes 28 for feeding the gas or the vapor to the filter tow.

EXAMPLES

The invention will now be described with respect to the following examples. They are not considered limiting. They are exemplary only.

The invention is tested on a modified apparatus, shown in principle in FIG. 1, from Hauni-Werke Korber & Co. KG, 2050 Hamburg-Bergedorf, Federal Republic of Germany, for the production of cigarette filter rods. This apparatus is designed for operating speeds of up to 600 m/min and consists of a preparation unit referred to as AF 2 and, downstream thereof, a processing unit referred to as KDF 2.

The operating speed is 400 m/min for all examples.

EXAMPLE 1

For this example, a filter tow of crimped cellulose 2,5-acetate filaments is used, with an individual filament denier of 3 den (equivalent to 3.3 dtex) and Y-shaped filament cross section. The total denier of the filter tow was 35,000 den (equivalent to 39,000 dtex).

The apparatus used is the Hauni-Werke apparatus described above for producing cigarette filter rods, which is equipped with an intake nozzle and an intake funnel. Viewed in the direction of movement of the filter tow, the intake nozzle and the intake funnel following it are arranged downstream of the deflection rollers and immediately upstream of the intake finger (cf. e.g. FIG. 1). The intake funnel possesses in its wall holes for the escape from the intake funnel of the air supplied through the intake nozzle.

The apparatus further possesses—in accordance with the invention—an intake finger of the type shown in FIGS. 3 and 4. The axis of the bores of the holes 17 (cf. FIGS. 3 and 4)—which are arranged in the wall of the intake finger on the filter tow intake side thereof—formed an angle of 20° to the longitudinal axis of this intake finger in the direction of movement of the filter tow.

By means of this apparatus according to the invention, paper wrapped cigarette filter rods are produced from the filter tow mentioned. The intake nozzle is operated with air at a pressure of 0.3 bar. Air is fed to the filter tow under a pressure of 3 bar through the inlet 19 of the jacket 18 and hence through the holes 17 in the wall of the intake finger 14 (cf. FIGS. 3 and 4).

The cigarette filter rods obtained in accordance with the invention, each have a length of 126 mm and a diameter of 7.84 mm. They had in each case a weight of 728 mg of cellulose 2,5-acetate and a drawing resistance of 473 mm water gauge (equivalent to 47.3 mbr or 4730 Pa).

The coefficient variation, that is to say the distribution of the drawing resistances of these cigarette filter rods obtained in accordance with the invention, is only 1.9%.

EXAMPLE 2 (COMPARATIVE EXAMPLE)

Example 1 was repeated, but with the difference that the apparatus used possesses not an intake finger according to the invention, but a conventional, known intake finger as shown in FIG. 2. The intake nozzle is operated with air under a pressure of 1 bar.

The filter tow used is the same as in Example 1.

The paper wrapped cigarette filter plugs obtained—in accordance with the state of the art—have in each case a length of 126 mm and a diameter of 7.84 mm. They possessed in each case a weight of 729 mg of cellulose 2,5-acetate and a drawing resistance of 449 mm water gauge (equivalent to 44.9 mbar or 4490 Pa).

The coefficient of variation, that is to say the distribution of the drawing resistances of these cigarette filter rods, obtained in accordance with the state of the art, was substantially greater than that of the cigarette filter rods obtained in accordance with Example 1, at 3.1%.

EXAMPLE 3

Example 1 is repeated, but with the difference that the apparatus possesses a pipe for feeding a gas or vapor to the filter tow in the direction of movement thereof, and—instead of the intake finger according to Example 1—an intake finger having in the wall thereof, on the filter tow intake side, holes for the escape from the intake finger of the gas or vapor supplied through the pipe. These holes are of the type shown in FIGS. 8 and 9. Air under a pressure of 2 bar is passed to the filter tow in the direction of movement thereof through the above-mentioned pipe. Also, the intake nozzle is operated with air under a pressure of 0.3 bar.

The gas or vapor exit end 23 of the pipe 22 shown in FIGS. 8 and 9 is designed as an annular slit nozzle by means of solid insert 24, which possesses a lesser diameter than the internal diameter of the pipe 22. It is connected by three webs 25 (cf. FIG. 10) with the inner wall of the pipe 22. The pipe 22 is round, and leads—viewed in the direction of movement of the filter tow—from a compressed air source through the intake nozzle 12 into the intake funnel 13. The gas or vapor exit end 23 of the pipe 22 terminate in the region of the filter tow intake side of the intake finger 14.

The filter tow used is the same as in Example 1.

The paper wrapped cigarette filter rods obtained in accordance with the invention, each have a length of 126 mm and a diameter of 8.06 mm. They possess in each case a weight of 727 mg of cellulose 2,5-acetate and a drawing resistance of 387 nm water gauge (equivalent to 38.7 mbar or 3870 Pa).

The coefficient of variation of these cigarette filter rods obtained in accordance with the invention was only 1.6%.

EXAMPLE 4 (COMPARATIVE EXAMPLE)

For the purpose of comparison with Example 3, Example 2 is repeated here, but with the difference that the intake nozzle is operated with air under a pressure of 0.7 bar and cigarette filter rods having a diameter of 8.06 mm are produced.

The filter tow used is again the same as in Example 1.

The paper-wrapped cigarette filter rods obtained—in accordance with the state of the art—each have a length of 126 mm and a diameter in this case of 8.06 mm and possessed in each case a weight of 727 mg of cellulose 2,5-acetate and a drawing resistance of 368 mm water gauge (equivalent to 36.8 mbar or 3680 Pa).

The coefficient of variation of the drawing resistances of these cigarette filter rods obtained in accordance with the state of the art is substantially greater than that of the cigarette filter rods obtained in accordance with Example 3, at 2.5%.

EXAMPLE 5

For this example, a filter tow of crimped cellulose 2,5-acetate filaments is used, having an individual filament denier of 2.5 den (equivalent to 2.8 dtex) and a Y-shaped filament cross section. The total denier of the filter tow was 35,000 den (equivalent to 39,000 dtex).

The apparatus used corresponded to the apparatus used for Example 1, but with the difference that the inlet nozzle 12 was omitted.

By means of this apparatus, paper wrapped cigarette filter rods are produced from the above-mentioned filter tow. Air at a pressure of 4 bar is fed to the filter tow through the inlet 19, of the jacket 18, and hence through the holes 17 in the walls of the intake finger 14 (cf. FIGS. 3 and 4).

The cigarette filter rods obtained in accordance with the invention, each have a length of 126 mm and a diameter of 7.35 mm. They possess in each case a weight of 760 mg of cellulose 2,5-acetate and a drawing resistance of 430 mm water gauge (equivalent to 43.0 mbar or 4300 Pa).

The coefficient of variation of the drawing resistances of these cigarette filter rods obtained in accordance with the invention is only 1.4%.

EXAMPLE 6 (COMPARATIVE EXAMPLE)

Example 5 is repeated, but with the difference that an intake nozzle 12 is present and this is operated with air under a pressure of 0.8 bar. The apparatus used possesses not an intake finger according to the invention, but a conventional known intake finger as shown in FIG. 2.

The paper wrapped cigarette filter rods obtained—in accordance with the state of the art—each have a length of 126 mm and a diameter of 7.85 mm. They possess in each case a weight of 760 mg of cellulose 2,5-acetate and a drawing resistance of 412 mm water gauge (equivalent to 41.2 mbar or 4120 Pa).

The coefficient of variation of the drawing resistances of these cigarette filter rods obtained in accordance with the state of the art was much greater than that of the cigarette filter plugs obtained in accordance with Example 5, at 1.8%.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

I claim:

1. A method for producing tobacco smoke filter rods having improved drawing resistance and an improved coefficient of variation from a filter tow of crimped spun fibers and/or filaments, the method comprising spreading, loosening, stretching, and relaxing the filter tow in a preparation zone, then passing the filter tow to a processing zone for gathering together the filter tow in an intake zone, the intake zone having an intake finger means, treating the filter tow with a gas or vapor under elevated pressure in the direction of movement of the filter tow at an angle of less than 90° to the axis of the filter tow with the aid of an intake nozzle for conveying the filter tow preceding the intake finger means, forming a continuous tobacco smoke filter rod and cutting the continuous filter rod into individual tobacco smoke filter rods, characterized in that the filter tow is treated a second time, after passing through the intake nozzle, in the intake finger means with a gas or vapor under elevated pressure in the direction of movement of the filter tow at an angle of less than 90° to the axis of the filter tow, and the gas or vapor is permitted to escape from a sidewall of the intake finger means thereafter;

wherein the drawing resistance of the filter rods is substantially uniform and the coefficient of variation thereof is low.

2. The method according to claim 1, wherein air is used as the gas.

3. The method according to claim 1, further comprising wrapping the filter tow with a wrapping strip prior to forming a continuous tobacco smoke filter rod.

4. The method according to claim 1, further comprising treating the filter tow with plasticizer in the preparation zone prior to passing the filter tow to the processing zone.

5. The method according to claim 1, wherein the tobacco smoke filter rod is a cigarette filter rod.

* * * * *